United States Patent [19]

Warscheit

[11] 3,978,495

[45] Aug. 31, 1976

[54] FILM CASSETTE FOR A PHOTOCOMPOSING MACHINE

[75] Inventor: Helmut Warscheit, Ober-Roden, Germany

[73] Assignee: Mergenthaler Linotype GmbH, Frankfurt, Germany

[22] Filed: Feb. 12, 1975

[21] Appl. No.: 549,385

[30] Foreign Application Priority Data

Feb. 11, 1974 Germany ..... 46121[U]

[52] U.S. Cl. ..... 354/5; 242/74.1; 354/216; 354/275

[51] Int. Cl.[2] ..... B41B 13/00; B65H 75/28

[58] Field of Search ..... 354/5, 275, 216; 242/74, 74.1

[56] References Cited

UNITED STATES PATENTS 2,941,743 6/1960 Cochrane et al. ..... 242/74 X 3,856,394 12/1974 Linde ..... 354/5 X

FOREIGN PATENTS OR APPLICATIONS 13,171 1968 Japan ..... 354/5

*Primary Examiner*—Richard A. Wintercorn

*Attorney, Agent, or Firm*—William P. Keegan

[57] ABSTRACT

A film cassette having a take-up reel with a clamping mechanism for gripping the leading end of a film strip and which reel is motor driven to wind exposed film into the cassette; the drive motor is disconnected from the reel to permit the reel to be freely rotated and exposed film wound thereon to be unwound and removed from the cassette. An actuating lever is provided to close the clamping mechanism and connect the motor to the take-up reel and to open the clamping mechanism and disconnect the motor.

3 Claims, 3 Drawing Figures

FILM CASSETTE FOR A PHOTOCOMPOSING MACHINE

The present invention relates to a film cassette for a photocomposing machine. More particularly, the invention relates to a film cassette having a motor driven take up reel which is provided with a clamping mechanism for attaching the leading end of a film strip to the reel.

Film cassettes of the above type have an advantage over cassettes in which the film is simply pushed into a loose spiral in a cylindrical chamber, and that is that the film can be tightly wound on a motor driven take up reel with the result that a greater quantity of film can be fed into the cassette. Also, layers of film do not slide against each other as they do when the film is pushed into a cassette.

The operation of a film cassette having a motor driven take up reel may be considered as involving three distinct functions, namely, (a) introduction of the end of the film into the cassette and clamping it to the reel; (b) winding of exposed film onto the reel, and (c) unwinding of the exposed film from the reel for feeding into a film developing apparatus while the reel is disconnected from its drive motor. It is preferable that the film cassette be adapted to perform either of the above functions under control of a simple manual device.

In accordance with the present invention a single actuating lever is provided for opening and closing a reel clamping device and for connecting the take up reel to its driving motor.

In one position of the actuating lever, the clamping device is open to receive the leading end of the film strip. After insertion of the film into the clamping device, the actuating lever is moved into its normal operating position which causes the clamping device to clamp the film and to connect the take up reel to the driving motor. To unload the cassette, the actuating lever is moved again into the position described above in which the film can easily be unwound from the take up reel and the end of the film moved out of the clamping device.

A particular useful further development of the actuation mechanism has been provided for a film cassette of the kind described above which is furnished with an arrangement for controlling the film tension. Thus, there is provided within the film cassette a spring-biased rocker arm that is tiltingly supported relative to the take up reel. The film is directed over the rocker arm which is connected to the actuation element of a switch that controls the operation of the drive motor for the take up reel. If the spring-biased rocker arm can be tilted by the force of the spring, because of the looseness of the film over the arm, the reel drive motor is switched on which causes the rocker arm to be pulled by the film, against the force of the spring, towards the take up reel until the motor is switched off. The rocker arm can be moved in the way described above when the actuating lever is in the normal operation position. For performing the loading and unloading functions, the actuating lever is moved into another position in which the lever arrests the rocker arm in a position nearer to the take up reel. Through the switch which is connected to the rocker arm, the reel motor is switched off. Since the take up reel is disconnected from the drive motor at this time, it may easily be rotated into the position in which the film end can be clamped to the reel by the clamping device. When unloading the film, the rocker arm is also arrested in the position nearest to the take up reel. Therefore, the rocker arm cannot pull a film end which has been cut off outside the cassette into the cassette. Rather, the film end will project from the cassette and enable the exposed film in the cassette to be fed into a developing device.

Features and advantages of the invention may be gained from the foregoing and from the description of a preferred embodiment thereof which follows.

Figure 1:
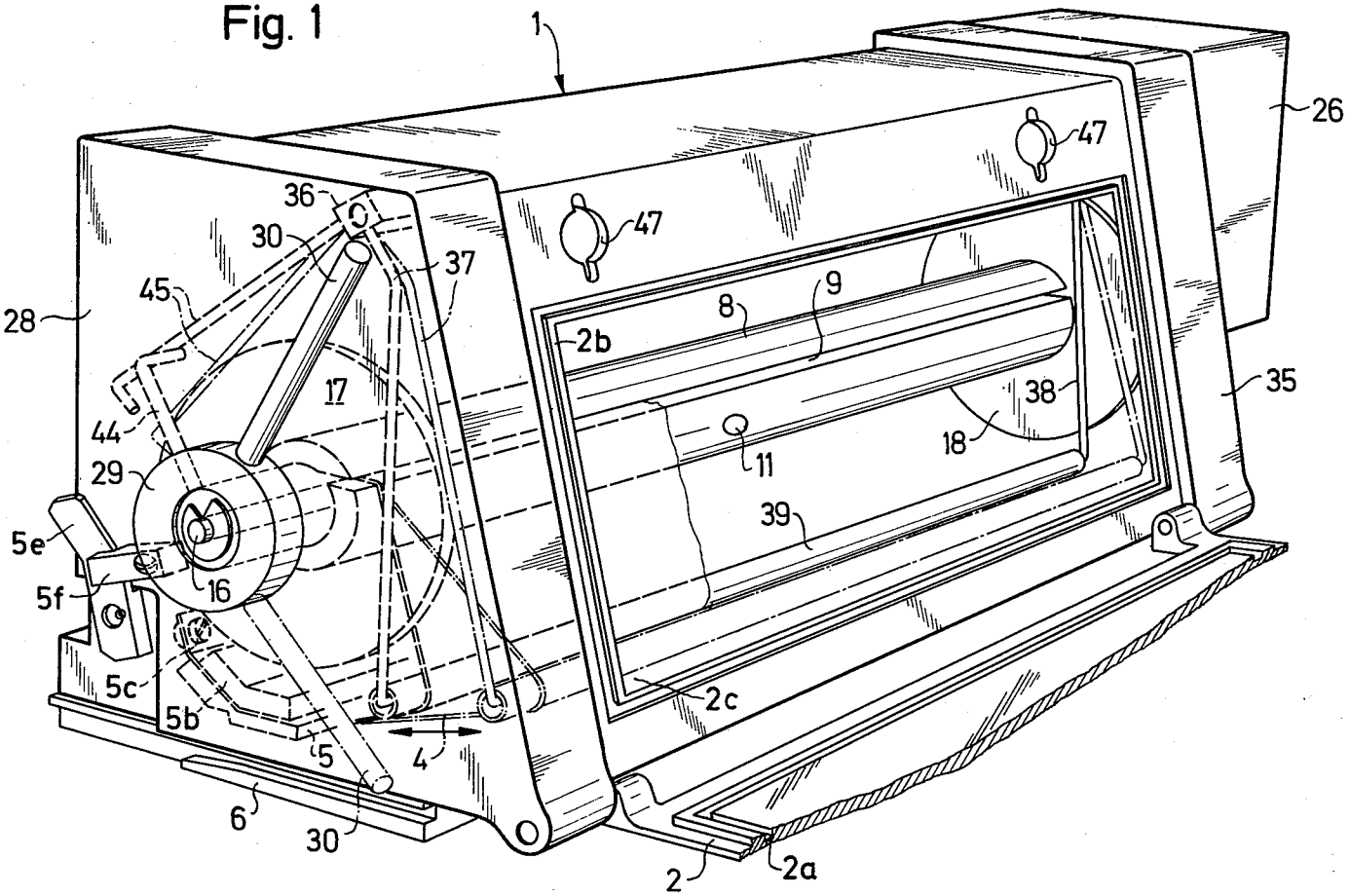
FIG. 1 shows a perspective view of the film cassette.

The interior of light impermeable housing 1 of the film cassette is accessible from one side through removable cover 2. During normal film exposing operations and during the operation of unloading exposed film, cover 2 remains closed with the aid of slide catches 46 engaging into openings 47 of housing 1. On the opposite side, there is an aperture 3 for the introduction of the film 4. Aperture 3 can be covered from within by a light proof shutter 5 fastened to a resiliently mounted cover sheet **5*b* which is covered, at least at the outer portions, with foam material. The foam material serves as a lightproof seal relative to plates 28 and 35. The cover sheet is screwed, with bolt 5*c* and shim 5*d*, to rotatable square shaft 5*a*. The elongated square shaft extends through plate 28 and is, on the outside, fastened to actuation lever 5*e*. In FIG. 1 the actuation lever 5*c* is held by arresting lever 5*f* provided on plate 28 in such a position that the shutter is open. When the film cassette is inserted into the photocomposing machine, lever 5*e* can be held in the same position by a cam (not shown) instead of by arresting lever 5*f*. The film cassette can be slid, by rails 6, 7, onto a photocomposing machine and can also be removed therefrom. Along the edge of the cover 2, a profile 2*a* is provided forming together with a corresponding profile 2*b* around rear opening 2*c*** of the housing a light-proof labyrinth.

Figure 2:
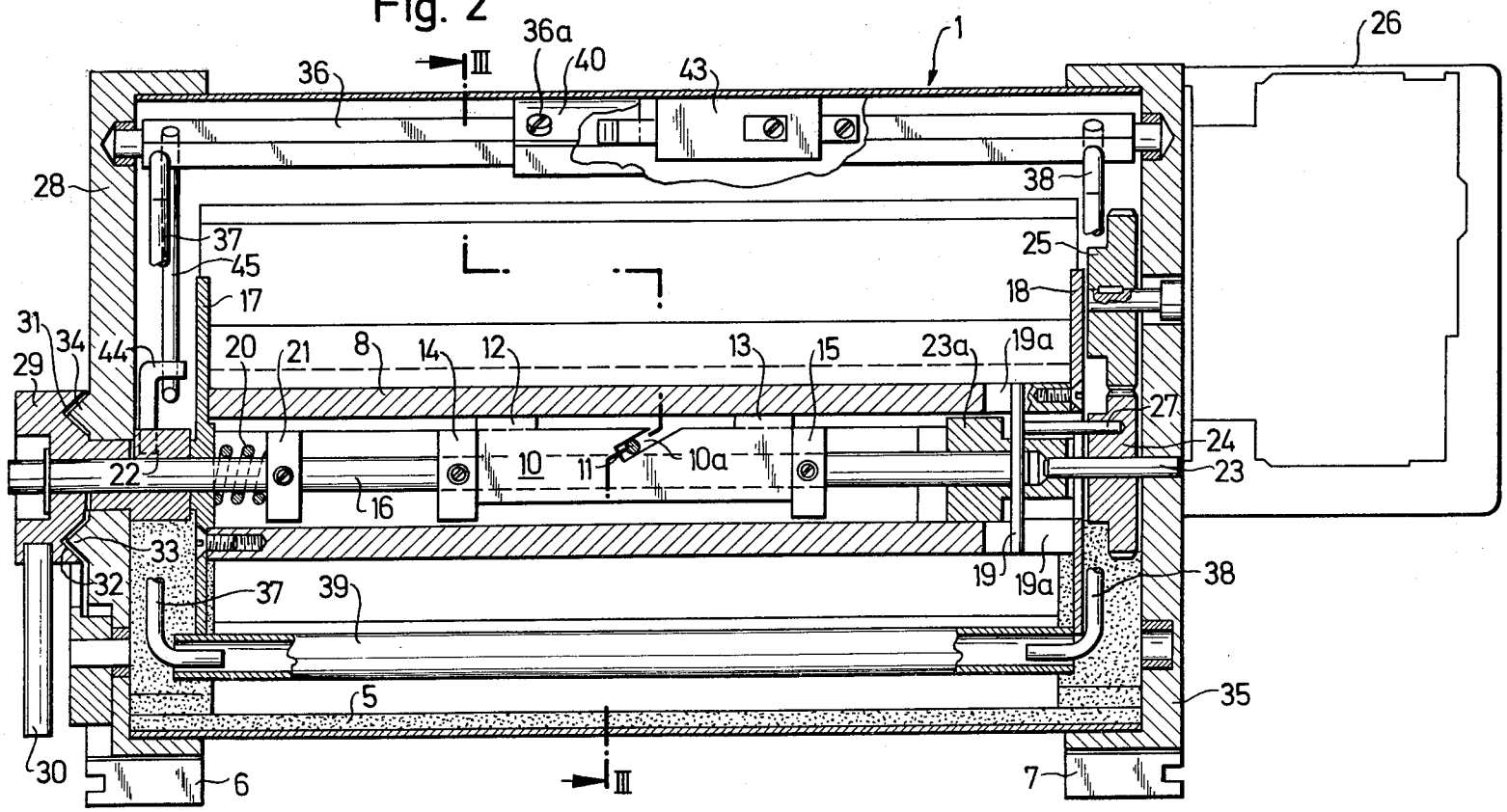
FIG. 2 shows a longitudinal section of the film cassette.
Figure 3:
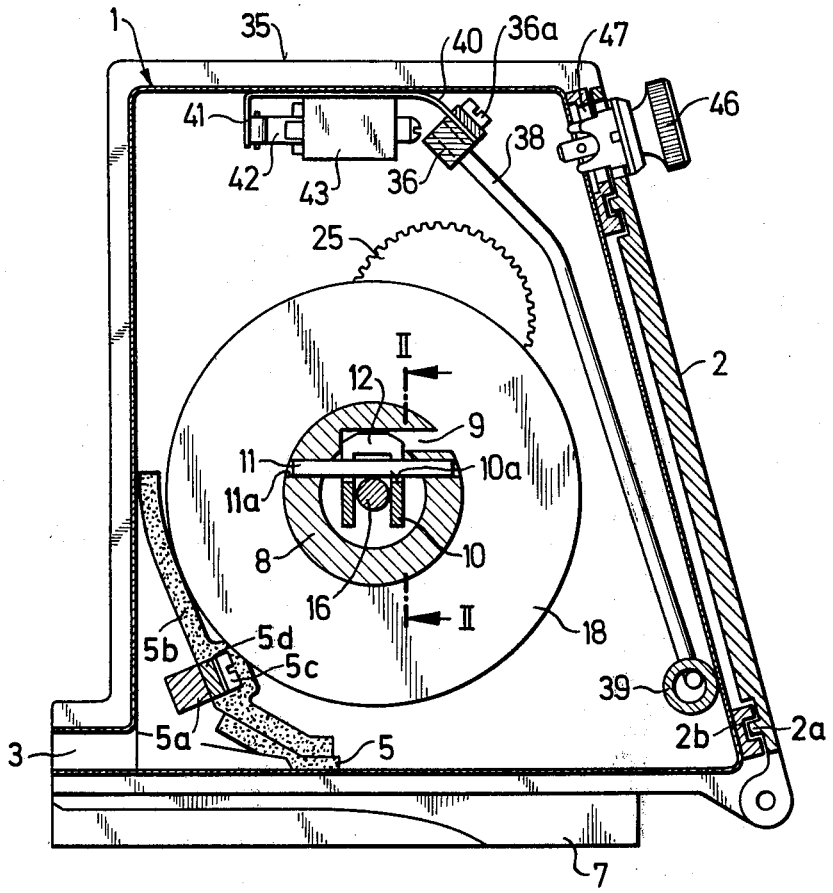
FIG. 3 shows a sectional view taken along line III — III of FIG. 2.

A take up reel 8 is rotatably supported within the film cassette. It is designed as a slotted hollow shaft having a slot 9 the shape of which is shown in detail in FIG 3. With the hollow shaft, there is provided a generally U-shaped clamping jaw 10 which can be displaced in an axial direction. The clamping jaw shows an oblong hole **10*a* which according to FIG. 2 is beveled and wherein a pin 11 is slidingly arranged. The ends of the pin 11*a* are fastened in the take up reel 8. The clamping jaw 10 with its two endpieces 12, 13, together with the reel 8, forms the clamping device. In order to actuate the clamping device, the clamping jaw is supported for radial movement between two discs 14, 15. The discs are screwed to a shaft 16 and can be shifted together with it in an axial direction within reel 8. Two flanges, 17 and 18,** which are screwed to the sides of the slotted hollow shaft constitute part of the take up reel.

Shaft 16 can be shifted, but not rotated, within the take up reel because a cross pin 19 extending through the shaft projects into oblong slots **19*a* in reel 8.**

The cross pin 19 and the clamping jaw 10 as well as shaft 16 are held in the shown position into which they are pressed by spring 20 between the left flange 17 and a further ring 21 fastened to the shaft. On the left side of FIG. 2, the shaft 16 is rotatably and movably supported within a plain bearing 22. On the other side, it is supported by a pin 23 extending into a slider 23*a*. The pin serves at the same time as the bearing of a driven gear 24. Gear 24 meshes with an intermediate drive gear 25 which is connected to an electric motor 26 designed as a geared motor. In the position shown in FIG. 2, the cross pin 19 bears against a follower pin 27 press fitted into gear 24.

On the opposite side, shaft 16 projects beyond plate 28. The projecting end is rotatably, though not shiftably, supported within head piece 29. An actuation lever 30 is embedded in the head piece. In the side facing the plate, the headpiece shows recesses, namely four recesses regularly spaced and having the same radius. On the drawing, recesses 31 and 32 are illustrated. The recesses correspond to four cam-like elevations on the plate, of which elevations 33 and 34 are shown in FIG. 2.

In plate 28 and plate 35 at the other end, a rocker assembly comprising square shaft 36, two arms 37 and 38, and a roller 39 rotatably supported by arms 37 and 38, is provided. Leaf spring 40 is secured to the square shaft 36 by bolts 36*a* and bears against the interior of housing 1. provided. By the leaf spring, the rocker assembly is swung away from reel 8. The arms of the rocker are so dimensioned that roller 39 is beneath take up reel 8 just facing aperture 3. A bent end 41 of the leaf spring 40 presses against actuation element 42 of a microswitch 43 secured to the housing. The microswitch is included in the circuit of motor 26.

Within the housing, a lever 44 is embedded in the plain bearing connected with head piece 29. Lever 44 is within the field of traverse of a second lever 45 which is fastened to the square shaft 36 of the rocker assembly.

It should be noted that in the following description of the operation of the actuation mechanism, the mechanism is shown in FIG. 1 in the film loading and unloading position of the film cassette, while in FIG. 2 it is shown for normal operation, i.e., the position it is in when clamping and reeling a strip of film.

If actuation lever 30 is turned from the normal operation position shown in FIG. 2, which is indicated in FIG. 1 by dotted lines, into the loading and unloading position, indicated in FIG. 1 by continuous lines, the head piece 29 is pushed out by the elevations of plate 28 of FIG. 2 against the force of spring 20, shaft 16 being pulled to the left. Clamping jaw 10 is now also shifted to the left and is drawn downwardly because the beveled oblong hole 10*a* glides along the fixed pin 11 to the left.

The end pieces 12 and 13 of the clamping jaw now no longer press against reel 8 from within, but give way to slot 9. At the same time, cross pin 19 in shaft 16 is pulled to the left so that it no longer engages with follower pin 27. That means that in this position for loading and unloading the film cassette, shaft 16 is disconnected from motor 26. Moreover, the take up reel clamping mechanism is open for introducing or withdrawing the film. If the actuation lever is turned from the position shown in FIG. 1 by dotted lines into the load/unload position indicated by continuous lines, actuation lever 44 engages simultaneously with second lever 45 thereby pressing the rocker assembly, against the force of leaf spring 40, into the position shown in FIG. 1 by dotted lines. In this position of the rocker assembly motor 26 is switched off by switch 43.

If contrary thereto, the actuation lever is in the operation position, which is shown in FIG. 2 and indicated in FIG. 1 by dotted lines, shaft 16 is, under the pressure of spring 20, in such a position that clamping jaw 10 is pressed by pin 11 from within against reel 8. At the same time, cross pin 19 which has been moved to the right is engaged with follower pin 27. Lever 44 is turned away from second lever 45 so that the rocker assembly can freely move. Therefore, under the force of leaf spring 40, it moves into the position shown in FIG. 3 in which it is far away from reel 8. Switch 43 is closed and the reel 8 is rotated by its drive motor.

An empty film cassette is inserted, with the aid of the lever which is in the load/unload position, into the photocomposing machine and locked in position. Thereupon cover 2 is opened and the film feed in the photocomposing machine is actuated until the film end has run into the film cassette. The film is then coiled around roller 39 of the rocker assembly and the film end is fed into slot 9 of take up reel 8. Prior thereto, reel 8 has been rotated into the position shown in FIG. 1.

Subsequently, the actuation lever is brought into the operation position. This causes to film end to be clamped. At the same time, reel 8 is connected to motor 26 which is switched on by the switch 43 if the free film end is long enough. When cover 2 has been replaced again, the film cassette is prepared for coiling up the exposed film.

When taking the film cassette from the photocomposing machine so that the exposed film therein can be developed, the actuation lever is turned back into the load/unload position. Lever 44 moves away from second lever 45, motor 26 is switched off and reel 8 is diconnected from it. The film end cut away at the outside of the cassette is not drawn into the film cassette since the rocker assembly is held back by levers 44 and 45 and roller is pivotted towards reel 8. The cassette can be taken out of the photocomposing machine for further processing of the exposed film. Now the film can be unwound from reel 8 and can be inserted into the developing device.

Having thus described the invention it is apparent that many changes or variations to the preferred embodiment described could be made without departing from the spirit and scope of the invention. Therefore, it is intended that the description and drawing be interpreted in an illustrative rather than in a limiting sense.

What is claimed is:

1. A film cassette for a photocomposing machine comprising, a cassette housing having opposed side walls, a rotatable shaft extending between said housing sidewalls and through one of said sidewalls, a take up reel supported on said shaft for rotation therewith, an electric drive motor, clutch means for connecting said motor to said take up reel, a clamping device mounted on said shaft for clamping a film strip to said take up reel, and lever means for sliding said shaft axially with respect to said take up reel for simultaneously opening said clamping device and disengaging said clutch means.

2. A film cassette according to claim 1 including a roller member extending parallel to said take up reel over which film is directed to said take up reel, pivotally mounted means for moving raid roller member towards and away from said take up reel, spring means for biasing said roller member away from said take up reel, and means actuated by said lever means for pivotting said pivotally mounted means to move said roller member towards said take up reel when said lever means slides said shaft axially to open said clamping device and disengage said clutch means.

3. A film cassette according to claim 2 including switch means actuated by said pivotally mounted means when said last named means moves said roller member to a position away from said take up reel, said switch means controlling said drive motor to rotate said take up reel.

* * * * *